US008516843B2

(12) United States Patent
Bednarski

(10) Patent No.: US 8,516,843 B2
(45) Date of Patent: Aug. 27, 2013

(54) ENERGY RECOVERY SYSTEM OF CRYOGEN EXHAUST GAS FROM FREEZING SYSTEMS

(75) Inventor: Jerry Bednarski, Acworth, GA (US)

(73) Assignee: Linde Aktiengesellschaft, Munich (DE)

( * ) Notice: Subject to any disclaimer, the term of this patent is extended or adjusted under 35 U.S.C. 154(b) by 275 days.

(21) Appl. No.: 13/210,737

(22) Filed: Aug. 16, 2011

(65) Prior Publication Data

US 2012/0211194 A1 Aug. 23, 2012

Related U.S. Application Data

(60) Provisional application No. 61/378,506, filed on Aug. 31, 2010.

(51) Int. Cl.
*F25B 13/00* (2006.01)

(52) U.S. Cl.
USPC ..... 62/324.1

(58) Field of Classification Search
USPC ..... 62/324.1; 165/11, 96, 104.34
See application file for complete search history.

(56) References Cited

U.S. PATENT DOCUMENTS 5,237,833 A * 8/1993 Hayashida et al. ..... 62/324.6
5,297,396 A * 3/1994 Kitamoto ..... 62/175
6,679,321 B2 * 1/2004 Jin ..... 165/236

* cited by examiner

*Primary Examiner* — Melvin Jones
(74) *Attorney, Agent, or Firm* — Joshua L. Cohen

(57) ABSTRACT

An apparatus for recovering energy from freezer exhaust includes a heat exchanger disposed for coaction with a freezer in a first atmosphere, the heat exchanger having a first heat transfer surface in communication with the freezer exhaust and the first atmosphere, and a second heat transfer surface in communication with the freezer exhaust and the first atmosphere; a discharge conduit in communication with the first and second heat transfer surfaces, and extending to a second atmosphere remote from the first atmosphere; a first valve assembly disposed for coaction with the first and second heat transfer surfaces, the first valve assembly movable to direct a flow of the freezer exhaust to a select one of the first and second heat transfer surfaces or optionally to direct the flow to both the first and second heat transfer surfaces; and a first blower to move a flow of the first atmosphere to a select one or both of the first and second heat transfer surfaces for heat transfer with the flow of the freezer exhaust.

15 Claims, 3 Drawing Sheets

ENERGY RECOVERY SYSTEM OF CRYOGEN EXHAUST GAS FROM FREEZING SYSTEMS

BACKGROUND

The present invention relates to use of cryogen exhaust from freezing and chilling applications and systems.

Use of cryogen gas for freezing or chilling applications is known. Unfortunately, much of the gas which is not used is merely exhausted, wherein the heat exchange energy available from the exhausted gas is wasted, instead of being recovered for subsequent heat transfer use for the freezing system, the freezer plant or other applications.

BRIEF DESCRIPTION OF THE DRAWINGS

For a more complete understanding of the present embodiments, reference may be had to the following drawing figures taken in conjunction with the description of the embodiments, of which.

DETAILED DESCRIPTION OF THE INVENTION

Figure 1:
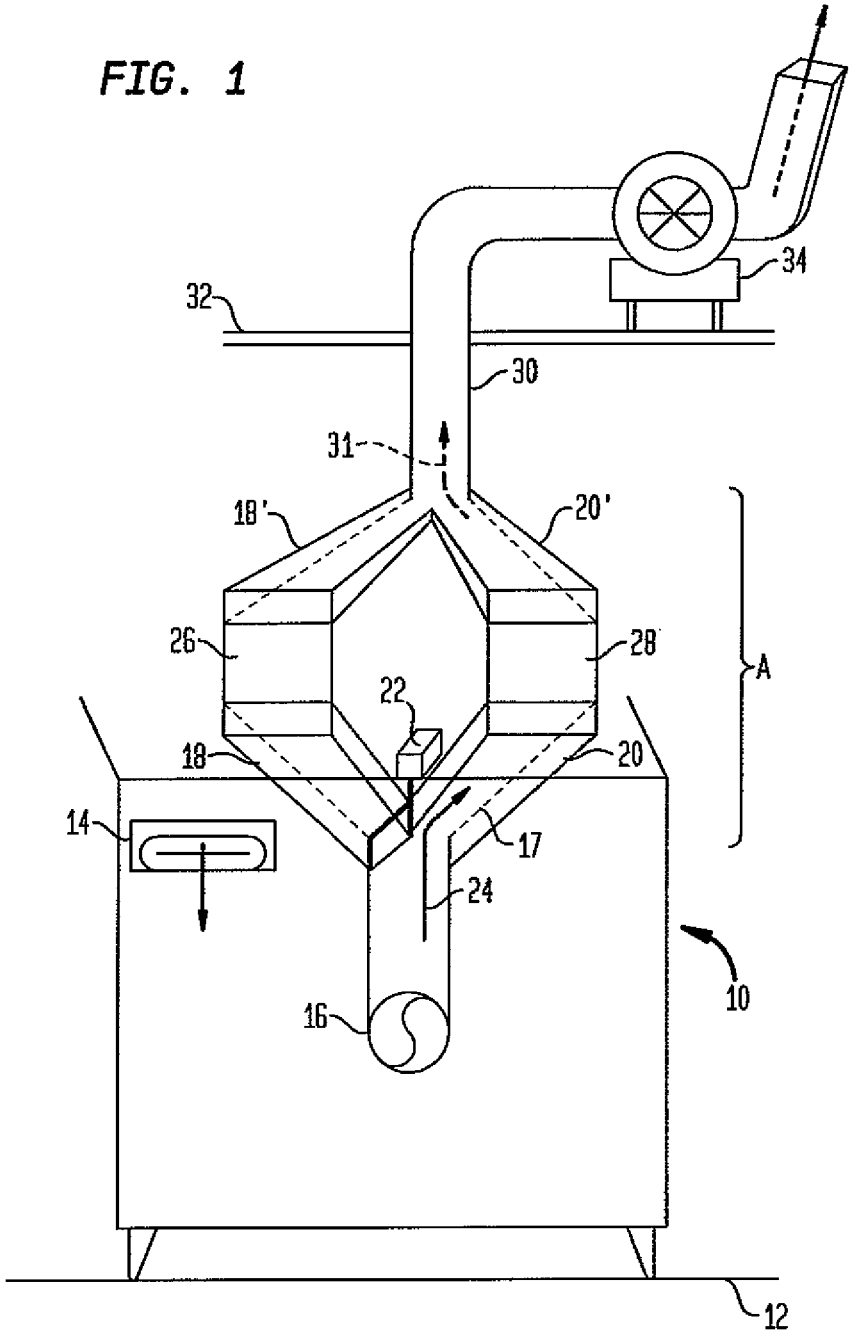
FIGS. 1 and 2 show front and side schematic views partially in cross-section, respectively, of an energy recovery system embodiment of the present invention.
Figure 2:
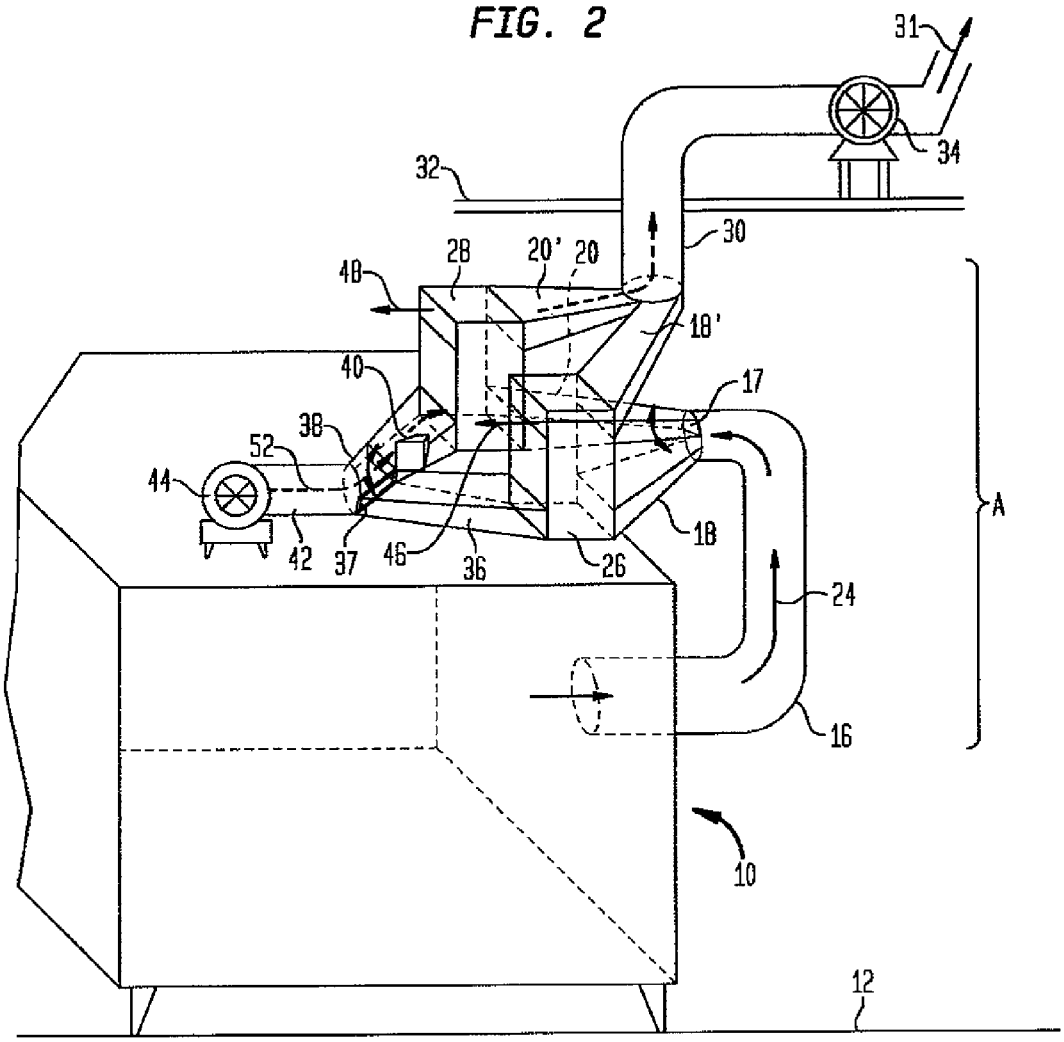

Referring to FIGS. 1 and 2 there is shown a freezer 10, such as a spiral, emersion or tunnel freezer, which is disposed on a floor 12 of a plant or factory. The freezer 10 is used to freeze, chill or cool products such as for example food products. The freezer 10 includes a product outlet 14 and an exhaust 16 from the freezer 10. The exhaust 16 removes unused cryogen from the freezer 10.

The exhaust 16 is bifurcated or branched at a diverter duct 17 into exhaust conduits 18,20 for which a switch valve 22 is associated therewith to control the flow of cryogen exhaust from the freezer 10 to each of the conduits 18,20. For example, cryogen exhaust 24 can be directed to either of conduit 18,20 depending upon the disposition of the switch 22. In FIG. 1 for example, the switch 22 is disposed such that the cryogen exhaust 24 is directed through conduit 20. It is also possible for the switch 22 to be positioned to permit the cryogen exhaust 24 to flow through both conduits 18,20 simultaneously.

Heat exchangers 26,28 are disposed in communication with the conduits 18,20, respectively. Therefore, the cryogen exhaust flow 24 directed through the conduit 20 will enter into the heat exchanger 28, after which upper conduit 20' in communication with the heat exchanger 28 continues to direct the exhaust through an upper exhaust conduit 30. The upper exhaust conduit 30 extends through a roof 32 of the plant. A blower 34 disposed on the roof 32 draws the cryogen exhaust 24 through the conduit 30. An upper conduit 18' extends from the heat exchanger 26 to the upper exhaust conduit 30 as well. Cryogen exhaust 24 can be directed through the conduit 18' if the switch 22 closes off the conduit 20.

Referring also to FIG. 2, conduits 36,38 are in communication with and connected to the heat exchangers 26,28, respectively. The conduits 36,38 intersect at another diverter duct 37 where a switch valve 40 is disposed for controlling flow of warmer plant air from the channels 36,38. The channels 36,38 are brought together to a single conduit 42 which is in communication with a blower 44 or fan.

Each one of the heat exchangers 26,28 provides for exhaust emissions shown generally by arrows 46,48, respectively.

This embodiment of the present invention is shown at components 16-48, collectively referred to as the energy recovery system embodiment "A".

The embodiment A operates as follows. Referring to FIGS. 1 and 2, by way of example the switch 22 has closed off conduit 18, such that the conduit 20 is open and clear, while the switch 40 has closed off the conduit 36 such that the conduit 38 is open and clear. The exhaust 24 travels up the exhaust pipe 16 along the conduit 20 into the heat exchanger 28 for heat exchange with warmer plant air 52. Concurrent therewith, the blower 44 pulls the warmer plant air 52, i.e. the ambient temperature of the plant atmosphere, and directs same as indicated by the arrow 52 through the conduit 38 to the heat exchanger 28. The warmer plant air 52 contacts the heat exchange member (coils, fins, etc., not shown) of the heat exchanger 28 in which the cooler cryogen exhaust 24 is present, heat transfer thereby occurs, after which the chilled ambient air 48 from the heat exchanger 28 is emitted back into the atmosphere of the plant to reduce the overall temperature of the plant. This is desirable for purposes of the plant operation maintaining the ambient temperature at a cooler or lesser temperature than would normally be the case in order to substantially reduce if not eliminate contaminates and contagens in the plant atmosphere. Unused cryogen shown at the arrow 31 is moved through the conduit 30 by the blower 34 and exhausted to the atmosphere external to the factory or used in a subsequent application.

At a certain point, the heat transfer by the heat exchanger 28 of the cryogen exhaust will cause freeze-up and require "de-riming" of the heat exchanger 28. Therefore, the valves 22,40 are switched to the opposite position to thereby open the conduits 18,36 for heat exchange in a similar manner with heat exchanger 26. As that is occurring, the heat exchanger 28 is permitted to de-ice and be cleaned so that it is ready for operation when the heat exchanger 26 must be shut-down for de-icing, etc. That is, the warm atmosphere drawn in by the blower 44 through the conduit 36 contacts heat transfer coils of the heat exchanger 26 in which the colder cryogen exhaust 16 is provided to effect heat transfer. This provides for the plant air to be cooled with the cooled air 46 emitted back into the plant atmosphere.

The heat exchanger 26 will eventually, as had occurred with the heat exchanger 28, freeze up and will require de-riming and at such time the valves 22,40 are again switched to alter the pathway of the cryogen exhaust 24 to provide heat transfer effect at the heat exchanger 28.

The arrangement of the embodiment permits for easy maintenance and repair of the heat exchangers 26,28, while still permitting at least one of the heat exchangers to continue operating.

It is possible to provide for switching of the conduits between the heat exchangers 26,28 based upon an amount of time that elapses or when a temperature of the plant air reaches a desired temperature. The present embodiments provide for reuse of sterile plant air inside the plant and thereby reduce the necessity for additional external or internal air-conditioning systems. Being able to switch between a plurality of the heat exchangers 26,28 eliminates the chance of ice plugging or blocking of the exhaust 46,48 and the conduits 18,20, 18',20' and 36,38. The heat exchangers 26,28 can be of the stainless steel type for easy cleaning and sanitation.

After the heat transfer effect to provide for the exhaust 46,48 into the plant atmosphere, the remaining cryogen exhaust is directed along the conduits 18',20' which converge into and communicate with the upper exhaust conduit 30, which is in communication with the roof exhaust blower 34.

Figure 3:
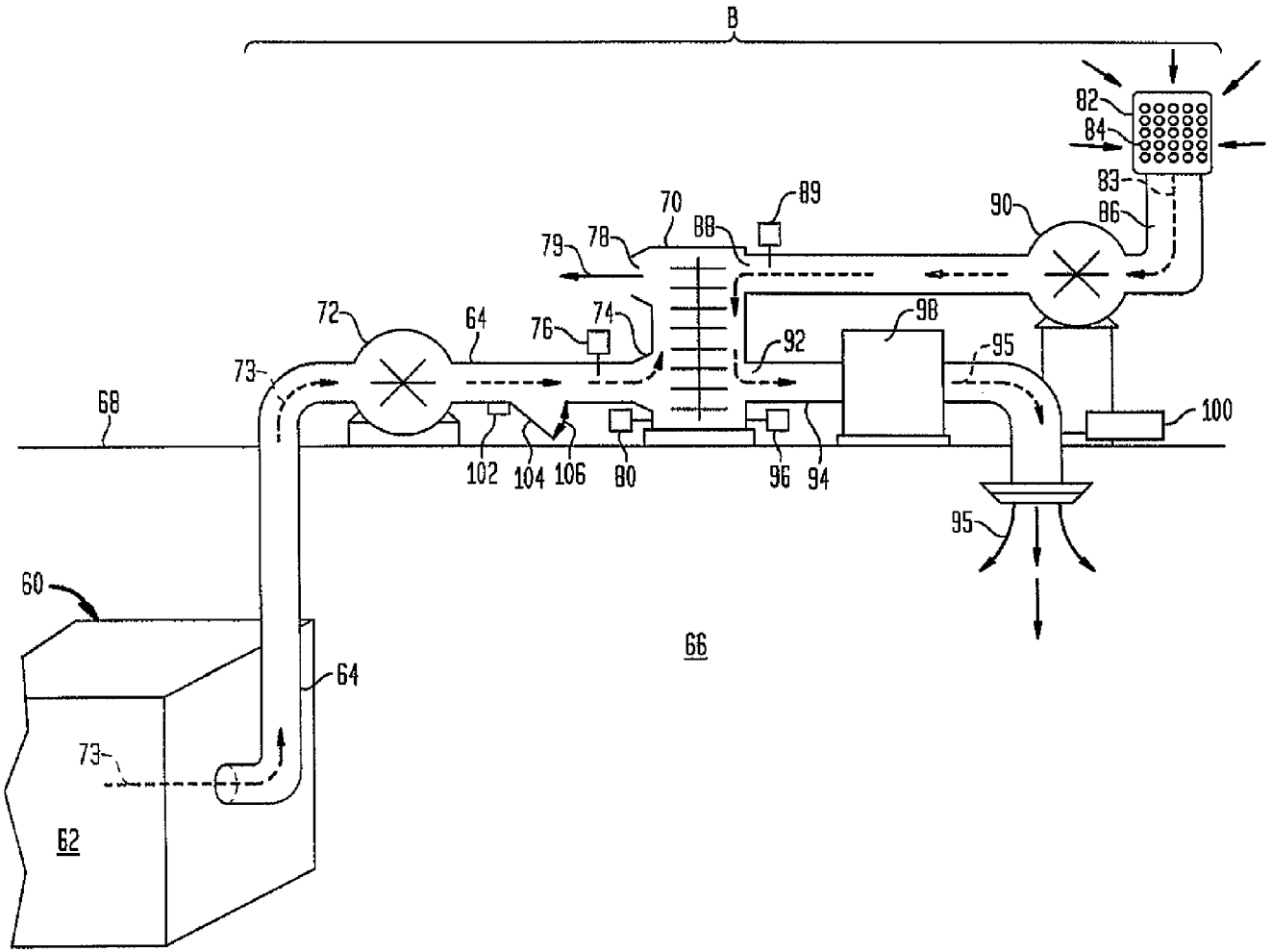
FIG. 3 shows a side schematic view partially in cross-section of another energy recovery system embodiment of the present invention.

Another embodiment is shown in FIG. 3, where there is shown a freezer 60 such as for example an immersion freezer, a tunnel freezer or a spiral freezer, having a freezing chamber 62 therein which is in communication with an exhaust duct 64 for venting any unused cryogen gas from the freezer chamber 62. The exhaust duct 64 may be insulated to prevent heat loss from same. The freezer 60 is disposed in a processing room 66 of a plant or facility having a roof 68.

The exhaust duct 64 extends in this embodiment up through the roof 68 of the plant where it is in communication with a heat exchanger 70. An exhaust blower 72 is interposed in the exhaust duct 64 for withdrawing unused cryogen gas 73 from the freezer 60 into the heat exchanger 70.

The heat exchanger is provided with an inlet 74 which is in communication with the exhaust blower 72. A differential pressure (D/P) switch 76 is in communication with the exhaust duct 64 proximate the inlet 74. The D/P switch measures the pressure difference between and across the duct 64. The heat exchanger 70 is also provided with an outlet 78. A temperature sensor 80 measures the cryogen vapor temperature in the heat exchanger 70 to aid in controlling the speed of the exhaust blower 72.

A fresh air intake 82 includes a particulate filter 84 disposed therein, the air intake 82 connected to a duct 86, which may also be insulated. The duct 86 is in communication with another inlet 88 of the heat exchanger 70. An air blower 90 is interposed in the duct 86 for communication therewith to draw fresh outside air through the intake 82 into the duct 86 and through to the inlet 88 of the heat exchanger. The intake 82 is disposed upstream of the blower 90 as shown in FIG. 3. The warmer outside air shown generally at arrow 83, is cooled upon exposure to the cryogen exhaust 73 transiting the heat exchanger 70 between the inlet 74 and the outlet 78.

Thereafter, the warm outside air 83 which has been cooled in the heat exchanger 70, exits the heat exchanger at an outlet 92 of the heat exchanger 70 to another duct 94. A temperature sensor 96 senses the chilled air prior to it being introduced into a filter unit 98. The filter 98 may also include an ultraviolet (UV) sterilizer. The filter 98 is interposed in the duct 94, the duct 94 passing through the roof 68 back into the processing room 66 providing a chilled sterile air flow 95 into said room.

A differential pressure (D/P) switch 89 is also provided in communication with the duct 86 proximate the inlet 88 of the heat exchanger 70. The D/P switch 89 measures the pressure difference across the duct 86. An $O_2$ sensor 100 is in communication with the duct 94 to monitor oxygen content of the air flow 95 prior to same being introduced into the processing room 66.

The present embodiment of FIG. 3 allows for maintaining the air in the processing room 66 at a lower temperature to thereby reduce the necessity of installed HVAC systems to be operated to cool the processing room 66 air. Maintaining the air in the processing room 66 at a reduced temperature inhibits bacteria and other contaminates and also puts less of a strain on a refrigeration system for the processing room 66.

The exhaust duct 64 is also provided with a vent spill valve 102 which actuates a valve door 104 built into the duct 64 proximate the inlet 74 of the heat exchanger 70. Should the switch 76 indicate pressure is at an unacceptable level at the inlet 74, this may indicate that there is plugging or fouling of the duct 64 and accordingly, the valve door 104 can be opened as indicated by the arrow 106 to clear the heat exchanger 70 of flow inhibiting material. The switch 76 can also be activated by the oxygen sensor 100 in the event levels of oxygen are too low in the air flow 95 returning to the processing room 66.

The outlet 78 of the heat exchanger 70 provides for the warmed cryogen exhaust indicated generally by arrow 79 to be vented to the atmosphere or used in subsequent applications.

This embodiment of the present invention is shown in components 64-106, collectively referred to as the energy recovery system embodiment "B". By monitoring temperature of the system with the sensors 80,96; and pressure at the ducts 64,86 with the D/P switches 76,89, freezing and ice fouling at the ducts is prevented by varying the speed of the cold exhaust air blower 72 and the warmer air blower 90. Time switching, instead of D/P (differential pressure) switching, can be used for the heat exchangers.

The heat exchangers 26, 28, 70 can be those distributed by Munters AB, Stockholm, Sweden, with offices in the United States.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. An apparatus for recovering energy from freezer exhaust, comprising:

a heat exchanger disposed for coaction with a freezer in a first atmosphere, the heat exchanger comprising a first heat transfer surface in communication with the freezer exhaust and the first atmosphere, and a second heat transfer surface in communication with the freezer exhaust and the first atmosphere;

a discharge conduit in communication with the first and second heat transfer surfaces, and extending to a second atmosphere remote from the first atmosphere;

a first valve assembly disposed for coaction with the first and second heat transfer surfaces, the first valve assembly movable to direct a flow of the freezer exhaust to a select one of the first and second heat transfer surfaces or optionally to direct the flow to both the first and second heat transfer surfaces; and a first blower to move a flow of the first atmosphere to a select one or both of the first and second heat transfer surfaces for heat transfer with the flow of the freezer exhaust.

2. The apparatus of claim 1, further comprising a second blower in communication with the discharge conduit to draw the flows of the freezer exhaust and the first atmosphere to the first and second heat transfer surfaces.

3. The apparatus of claim 1, wherein the second blower is disposed in the second atmosphere.

4. The apparatus of claim 1, further comprising an exhaust conduit having a first end in communication with the freezer exhaust, and a second end in communication with the first and second heat transfer surfaces; and a second valve assembly disposed for coaction with the first and second heat transfer surfaces, the second valve assembly movable to direct the flow of the first atmosphere to a select one of the first and second heat transfer surfaces or optionally to direct the flow to both the first and second heat transfer surfaces.

5. The apparatus of claim 1, wherein the first atmosphere is disposed in a factory and the second atmosphere is external to the factory.

6. An apparatus for recovering energy from freezer exhaust, comprising:

a heat exchanger disposed in a first atmosphere for coaction with a freezer disposed in a second atmosphere remote from the first atmosphere, the heat exchanger comprising a first inlet for receiving exhaust from the freezer, a second inlet for receiving a flow of the second atmosphere into the heat exchanger for heat transfer with the freezer exhaust, and an outlet for discharging a chilled airflow to the second atmosphere;

a first conduit having a first end in communication with the exhaust and a second end in communication with the first inlet of the heat exchanger; and a first blower operatively associated with the first conduit for moving the exhaust from the freezer to the first inlet of the heat exchanger.

7. The apparatus of claim 6, further comprising a second blower operatively associated with the second inlet to move the flow of the second atmosphere to the second inlet and through the heat exchanger for heat transfer with the flow of the freezer exhaust in the heat exchanger.

8. The apparatus of claim 7, further comprising a first filter operatively associated with the second blower to filter the flow of the second atmosphere provided to the second inlet of the heat exchanger.

9. The apparatus of claim 6, further comprising a second filter operatively associated with the outlet of the heat exchanger for filtering the chilled airflow.

10. The apparatus of claim 9, further comprising an ultraviolet sterilizer operatively associated with the second filter to sterilize the chilled airflow.

11. The apparatus of claim 9, further comprising a third sensor mounted for communication with the chilled air flow to sense a temperature of the chilled air flow exiting said outlet for said second filter.

12. The apparatus of claim 6, further comprising a first sensor mounted for communication with the outlet of the heat exchanger to sense an amount of oxygen in the chilled airflow.

13. The apparatus of claim 6, further comprising a second sensor mounted for communication with the heat exchanger for sensing a temperature of vapor in the heat exchanger to generate a signal for controlling the first blower.

14. The apparatus of claim 6, further comprising a door arranged in the first conduit between the first inlet and the first blower for releasing flow inhibiting material from the first conduit, and a pressure sensitive switch operatively associated with the first inlet to generate a signal to control movement of the door.

15. The apparatus of claim 6, wherein the second atmosphere is disposed in a factory and the first atmosphere is external to the factory.

* * * * *